United States Patent [19]

Moulinié et al.

[11] Patent Number: 4,589,242

[45] Date of Patent: May 20, 1986

[54] JOINING ELEMENT

[75] Inventors: Raoul M. Moulinié, Lachenaie; Guy Gagné, St. Sauveur des Montes, both of Canada

[73] Assignee: Z-Tech Enterprises Inc., Quebec, Canada

[21] Appl. No.: 610,608

[22] Filed: May 15, 1984

[51] Int. Cl.[4] ..... E04B 1/68; E04F 15/14

[52] U.S. Cl. ..... 52/396; 52/573; 404/47; 404/69

[58] Field of Search ..... 52/396, 403, 573; 404/47, 65–69

[56] References Cited

U.S. PATENT DOCUMENTS

| | | | |
|---|---|---|---|
| 2,976,782 | 3/1961 | Thom | 404/47 |
| 3,394,639 | 7/1968 | Viehmann | 404/47 |
| 3,447,430 | 6/1969 | Gausepohl | 404/69 |
| 3,527,009 | 9/1970 | Nyquist | 404/69 X |
| 3,745,726 | 7/1973 | Thom | 404/47 X |
| 4,021,984 | 5/1977 | Honegger | 52/396 X |
| 4,184,298 | 1/1980 | Blazer et al. | 52/573 X |
| 4,290,713 | 9/1981 | Brown et al. | 404/69 |
| 4,423,979 | 1/1984 | Brown | 52/396 X |

FOREIGN PATENT DOCUMENTS

| | | | |
|---|---|---|---|
| 1109690 | 9/1981 | Canada . | |
| 2208680 | 10/1973 | Fed. Rep. of Germany | 404/68 |
| 2344225 | 3/1975 | Fed. Rep. of Germany | 52/573 |
| 2421962 | 11/1975 | Fed. Rep. of Germany | 52/573 |
| 2609759 | 9/1977 | Fed. Rep. of Germany . | |
| 2136842 | 2/1983 | Fed. Rep. of Germany . | |

*Primary Examiner*—Donald G. Kelly
*Assistant Examiner*—Richard E. Chilcot, Jr.
*Attorney, Agent, or Firm*—Russell, Georges, Breneman, Hellwege & Yee

[57] ABSTRACT

This invention provides a one-piece joining element of extruded material suitable for joining floor or similar sections together comprising a main body having opposed top and bottom surfaces, the body having a first side having an upper wall section and a spaced apart lower wall section, a first chamber in the body adapted to receive a portion of a sealing member and an opening extending between the upper and lower wall sections of the first side. The opening is in communication with the first chamber and a second side in generally opposed relationship to the first side, the body having a second retention chamber adapted to receive a joinder member in engaging relationship therewith, the second side having an opening therein in communication with the second retention chamber, the opening forming a restricted mouth with the second chamber.

10 Claims, 3 Drawing Figures

JOINING ELEMENT

This invention relates to a joining element.

More particularly, this invention relates to a one-piece joining element which together with a seal with which it is adapted to be used, forms an expansion joint suitable for use in floors, or structures of a similar nature where it is desired to join together two or more surfaces and to allow for expansion or contraction of the surfaces.

Expansion joint members suitable for use in commercial or industrial applications are well known in the art and may typically comprise a formed steel member in which the structure is normally cold-rolled into shape, from a flat piece of steel. For floor expansion joints, which are normally substantially smaller in size than other similar joint or expansion members for highway construction or the like, the various criteria are somewhat different for the structural characterstics in terms of finishing characteristics, anchoring means and the like. For example, many expansion joints have a structure in which a separate flange is mounted to the expansion joint for the specific purpose of providing a surface on which anchors can be mounted for mounting the structure to a substrate; in such cases, the provision of extra flanges necessarily adds to the cost of the unit and tends to produce a bulkier unit than would normally be required.

In addition, for finishing purposes, particularly for industrial or commercial applications in buildings or the like, visible portions of the expansion elements should be of such a structure that they may receive a floor covering or the like. In other words, the structure of the expansion joint should contain some provision for having an over-laid portion of a flooring structure or the like.

It would be most desirable if a one-piece expansion joint member of a compact nature could be utilized, not only to reduce the cost of manufacture for such units but also, for ease of installation and to be able to anchor the same in place in a simple and convenient manner. Additionally, such a unit should desirably be readily connectable to adjacent units so as to form a continuous length of such joints formed of two or more individual joining elements.

With this invention, applicant has developed a one-piece joining element which can be formed in a very simple and expedient manner; in accordance with this invention, applicant has found that by forming the joining element from a solid monolithic body from a suitable rigid material such as an aluminum extrusion, a very compact and economical joining element can be made which does not have the disadvantages of the prior art arrangements.

More particularly, in accordance with this invention, there is provided a one-piece joining element of extruded material suitable for joining floor or similar sections together comprising a main body having opposed top and bottom surfaces, the body having a first side having an upper wall section and a spaced lower wall section, a first chamber in the body adapted to receive a portion of a sealing member and an opening extending between the upper and lower wall sections of the first side, the opening being in communication with the first chamber, and a second side in generally opposed relationship to the first side, the body having a second retention chamber adapted to receive a joinder member in engaging relationship therewith, the second side having an opening therein in communication with the second retention chamber, the opening forming a restricted mouth with the second chamber.

The top surface of the joining element may be of a substantially flat, planar nature, or it may be provided with a raised lip forming a stepped portion on the top surface to later receive a layer of material such as floor covering or the like when the device has been installed.

If the top surface of the joining element is provided with a raised lip, such lip may typically extend above the top surface of the joining element by ⅛ inch to 1 inch or more.

The first and second chambers are preferably in the form of elongated channels extending longitudinally through the body of the joining element, the chambers being separated from each other by a vertical wall extending from the top to the bottom of the joining element.

In its preferred form, the second chamber is provided with its mouth opening of a narrower width than the chamber itself. Still further, the mouth opening is preferably a continuously extending opening along the longitudinal length of the joining element.

The joining element may be formed from any suitable material extruded into the one-piece monolithic form of this invention. Suitable materials include steel, mangesium and other like metals. A particularly preferred material for formation of the joining element is aluminum in view of its lightweight and non-corrosive properties as well as its relatively inexpensive cost.

As will be appreciated, in use, normally a pair of the joining elements of this invention together with a sealing membrane would be provided, the joining elements being arranged in diametrically opposed relationship and having the sealing membrane extending therebetween.

The sealing membrane, as is known in the art, may be of any suitable flexible, elastomeric material such as Neoprene. The sealing membrane is usually of a continuous nature extending along the longitudinal length of the joining elements and having opposed lateral edges seated in the mouths and chambers of the joining elements. As will be appreciated, the sealing membrane may have any suitable configuration well known to those skilled in the art, depending on the intended use of the joint assembly and as well, the configuration of the upper and lower wall sections of the first side of the joining element which form the opening in which the sealing membrane sits. In a preferred form, the lower wall section has at least one surface which is substantially parallel to one surface of the upper wall section so that the sealing membrane rests in substantial sealing engagement therewith. The sealing membrane provides watertight seal for the joint and prevents debris from entering the joint, while permitting the expansion and/or contraction of the surfaces joined together by the joint assembly.

If the top surfaces of the joining elements are provided with raised lips, typically a covering such as a metal plate or other protective covering may be installed in the space between the lip portions of the opposed joining elements in order to provide protection for the joint assembly and to maintain a substantially level surface for the floor surface.

Having thus generally described the invention, reference will now be made to the accompanying drawings illustrating preferred embodiments, and in which.

Figure 1:
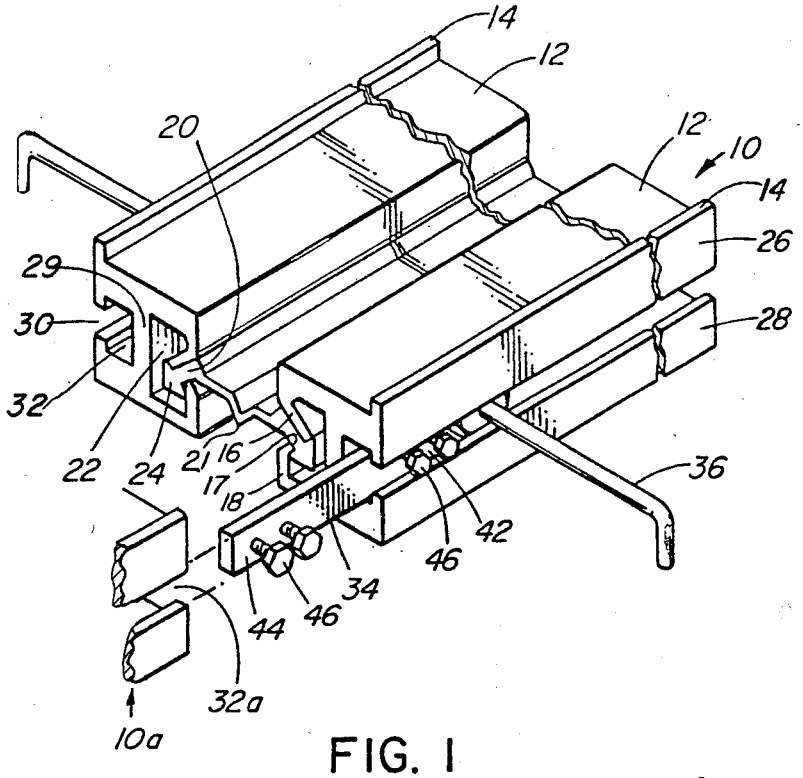
FIG. 1 is a perspective view of the joining element of this invention.

Referring now to FIG. 1, the joining element of this invention is illustrated in its preferred form, generally by reference numeral 10. FIG. 1 illustrates an assembly for joining spaced apart sections of floor, wall, etc., together. In this respect, it will be noted that a pair of joining members arranged in diametrically opposed relationship are illustrated. However, it should be appreciated that each joining member of the pair is substantially identical and thus, all description with regard to the joining member applies to both joining members shown in FIG. 1.

The joining element 10 is of a one-piece integral construction and comprises top surface 12 of a substantially flat, planar nature, which, in the embodiment shown, includes a raised lip 14 on one side thereof, thus providing top surface 12 with a stepped portion for receiving a layer of material as will be discussed hereinafter. The opposed bottom surface of element 10 is of a generally flat, planar nature as shown in the drawings.

Joining element 10 further comprises a first side constituted by upper wall section 16 and lower wall section 18. As will be seen from FIG. 1, upper wall section 16 is spaced apart from lower wall section 18 and thereby provides an opening or mouth extending longitudinally between the upper and lower wall sections. The opening defined by the spaced apart upper and lower wall sections 16 and 18 is adapted to receive a seal member such as indicated by reference numeral 20. The opening extending between the upper wall section 16 and lower wall section 18 is in communication with chamber 22 which is actually an elongated channel extending through the body of the joining element. Chamber 22, as will be seen from the drawings, receives a portion 24 of the sealing member 20.

As will be appreciated, wall sections 16 and 18 may be of any suitable configuration so as to receive the lateral edges of a seal in seating engagement therewith. Further, seal 20 too may have any desired configuration having opposed free lateral edges adapted to sit in the openings of the joining elements to seal a joint.

In the embodiment illustrated, seal 20 comprises a continuous elastomeric strip having outer opposed end members 24 of an arrow-shaped configuration nested in the longitudinal gap created by spaced apart wall sections 16 and 18, and further, seal 20 comprises a central V-shaped portion 21.

Further, upper wall section 16 comprises a downwardly and inwardly extending wall, while lower wall section 18 comprises an upwardly extending wall having top surface 17 approximately parallel with upper wall section 16.

Joining element 10 further includes a second side in generally opposed relationship to the first side. In the illustrated embodiment, the second side is constituted by upper wall 26 and spaced lower wall 28 with opening or mouth 30 extending longitudinally therebetween. Opening 30 communicates with a second retention chamber or elongated channel 32. Chambers 22 and 32 are separated from each other by vertical wall 29 extending from the top to the bottom of the joining element. Retention chamber 32 is adapted to receive a joinder member such as shown at 34 as will be discussed hereinafter. As will also be seen from FIG. 1, opening 30 formed by walls 26 abd 28 has a restricted mouth relative to the chamber 32. Chamber 32 is further adapted to receive an anchoring element 36 as discussed hereinafter.

Figure 2:
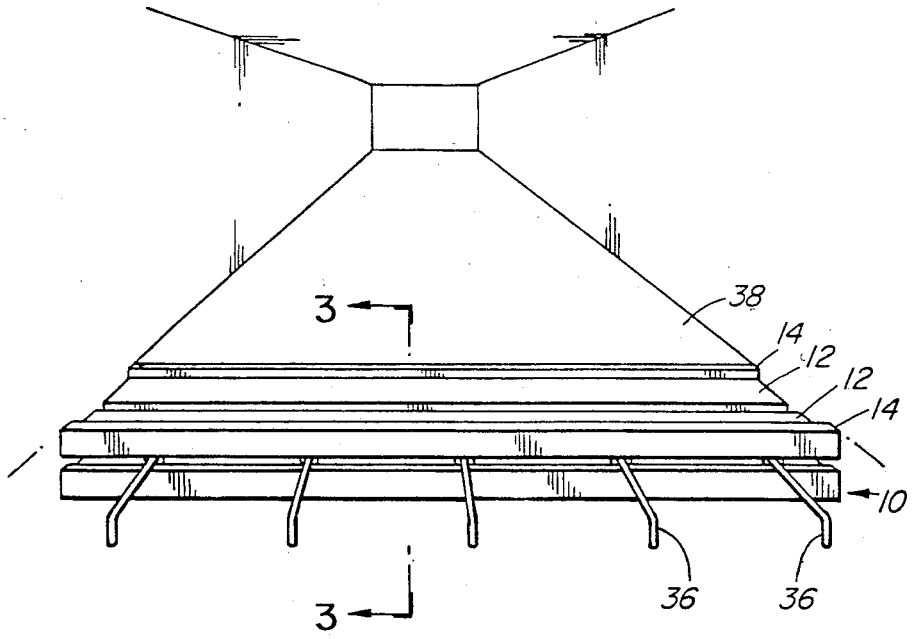
FIG. 2 illustrates a joint assembly using the joining element of this invention in a partially installed condition.

FIG. 2 illustrates a joining element of this invention in use partially installed to join two sections of floor together. As will be noted, the joining element extends across the width of the sections to be joined together. A plurality of anchor elements 36 are provided at spaced intervals along the longitudinal length of the joining element 10 for the purpose of anchoring the assembly in concrete. From FIGS. 2 and 3, it will be seen that when concrete is poured, top surface 38 of spaced apart sections 40 are in substantially the same plane as raised lip 14 of joining element 10.

In the embodiment shown in FIG. 2, it will be appreciated that the joining element extends continuously across the width of the floor sections to be joined together and thus, no joinder elements such as bars 34 of FIG. 1 are provided. However, if two or more joining elements are to be joined together, it will be seen from FIG. 1 that one end 42 of bar 34 is slidably inserted into retention chamber 32 with the other end 44 being inserted into retention chamber 32*a* of a further joining element 10*a*. Bar 34 is held in place by suitable means such as bolts 46.

Figure 3:
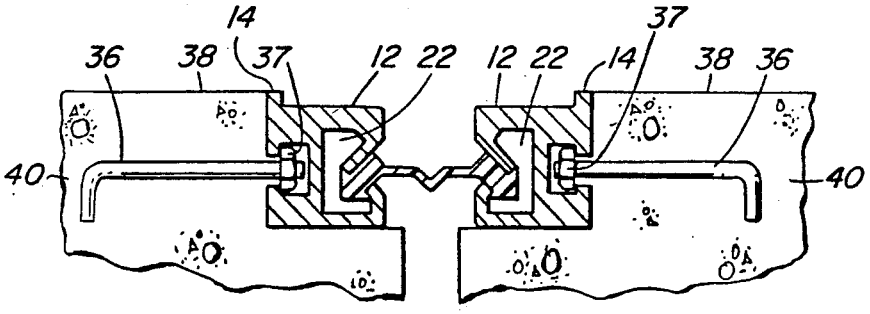
FIG. 3 is a section taken along the line 3—3 of FIG. 2.

As is best seen from FIG. 3, anchor bars 36 are held in retention chamber 32 by virtue of the restricted mouth opening of the chamber. Anchor bolts 36, as can be seen, comprise L-shaped members having nut 37 on one end thereof. Thus, nut 37 is dimensioned to be larger than the dimension of the opening 30 and to fit within the chamber 32 so that the nut 37 is slidably confined within the chamber 32, thus retaining anchor bolt 37 attached to the joining element 10.

It will also be seen from FIG. 3 that when the joining elements are provided with lips 14, top surfaces 12 of the joining elements are on a lower plane than surfaces 38. Top surfaces 12 may then be covered with a suitable covering (not shown) such as a metal grill, to protect the joint assembly and to provide a substantially level plane with surfaces 38. Such covering also provides relatively easy access to the joint assembly for maintenance purposes, etc.

As previously mentioned, top surface 12 may be provided without any raised lip. In either case, the joining element may be installed either in the same plane as the surfaces to be joined together or may be on a lower plane with a suitable insert or covering to maintain the substantially continuous evenness of the top surfaces over the joint assembly with the surface being joined together.

We claim:

1. A joint assembly for receiving a recessed type joining seal comprising a pair of spaced apart one-piece joining elements of extruded material with a sealing element therebetween, each joining element having a rectangularly shaped body in cross section formed of a top, elongated, horizontally extending planar supporting wall, an opposed parallel coextensive planar bottom wall, a first interior vertical front side wall extending between said top and bottom walls, said front side wall having an upper wall section extending downwardly and slanting inwardly from said top wall, and a spaced apart lower wall section extending upwardly from said bottom wall, and a second generally coextensive vertical rear side wall opposed to said first side wall and having an upper edge portion extending above said top wall forming a rear abutment edge for said top wall, said second side wall having a substantially planar upper wall section and a spaced apart substantially planar lower wall section, an elongated longitudinally extending aperture in each of said front and rear side walls intermediate said top and bottom walls, a first chamber in said front side wall adapted to receive a portion of a sealing member, said elongated longitudinally extending aperture in said front side wall forming a restricted mouth with said first chamber and being in communication with said first chamber in said front side wall, and a second chamber in said rear side wall adapted to receive a joinder member in engaging relationship therewith, said elongated longitudinally extending aperture in said rear side wall forming a restricted mouth with said second chamber and being in communication with said second chamber, and a sealing element extending between said opposed joining elements mounted beneath the top walls of said joining elements, said sealing element comprising opposed end members for insertion in said elongated longitudinally extending aperture in said front side wall.

2. The joint assembly of claim 1 wherein said upper wall section of said front side wall has a surface which is parallel to a surface of said lower wall section of said front side wall.

3. A joint assembly for receiving a recessed type joining seal comprising a pair of spaced apart one-piece joining elements with a sealing element therebetween, each joining element having a rectangularly shaped body in cross section formed of a top, elongated, horizontally extending supporting wall, an opposed parallel coextensive bottom wall, a first interior vertical front side wall extending between said top and bottom walls, and a second generally coextensive vertical rear side wall opposed to said first side wall and having an upper edge portion extending above said top wall forming a rear abutment edge for said top wall, an elongated longitudinally extending aperture in each of said front and rear side walls intermediate said top and bottom walls, a first chamber in said front side wall adapted to receive a portion of a sealing member, said elongated longitudinally extending aperture in said front side wall forming a restricted mouth with said first chamber and being in communication with said first chamber in said front side wall, and a second chamber in said rear side wall adapted to receive a joinder member in engaging relationship therewith, said elongated longitudinally extending aperture in said rear side wall forming a restricted mouth with said second chamber and being in communication with said second chamber, and a sealing element extending between said opposed joining elements mounted beneath the top walls of said joining elements, said sealing element comprising opposed end members for insertion in said elongated longitudinally extending aperture in said front side wall.

4. The joint assembly of claim 3 or 1, wherein said first and second chambers are separated from each other.

5. The joining element of claim 4 wherein said chambers are separated by a vertical wall extending from the top to the bottom of said joining element.

6. The joint assembly of claim 5 wherein said vertical wall constitutes a rear wall for both said first and second chambers.

7. The joint assembly of claim, 3, wherein said joining element comprises a solid one-piece body of extruded metal material.

8. The joining element of claim 7 wherein said material is aluminum.

9. The joint assembly of claim 3 or 1, wherein said second chamber comprises an elongated channel extending longitudinally through the joining element.

10. The joint assembly of claim 3 or 1 further including connecting means insertable into said second chamber for joinder of said joining elements with further joining elements.

* * * * *